US012484744B2

(12) United States Patent
Wu et al.

(10) Patent No.: US 12,484,744 B2
(45) Date of Patent: Dec. 2, 2025

(54) FAN ASSEMBLY AND VACUUM CLEANER WITH FAN ASSEMBLY

(71) Applicant: Globe (Jiangsu) Co., Ltd., Changzhou (CN)

(72) Inventors: Miao Wu, Changzhou (CN); Doushi Wang, Changzhou (CN); Xiazi Li, Changzhou (CN); Yabin Tang, Changzhou (CN)

(73) Assignee: Globe (Jiangsu) Co., Ltd., Changzhou (CN)

( * ) Notice: Subject to any disclaimer, the term of this patent is extended or adjusted under 35 U.S.C. 154(b) by 227 days.

(21) Appl. No.: 18/153,379

(22) Filed: Jan. 12, 2023

(65) Prior Publication Data

US 2023/0148808 A1 May 18, 2023

Related U.S. Application Data

(63) Continuation of application No. PCT/CN2021/118553, filed on Sep. 15, 2021.

(30) Foreign Application Priority Data

Sep. 23, 2020 (CN) ..... 202011008165.5
Dec. 7, 2020 (CN) ..... 202011414998.1

(51) Int. Cl.
*A47L 5/36* (2006.01)
*A47L 9/00* (2006.01)
(Continued)

(52) U.S. Cl.
CPC ..... *A47L 5/365* (2013.01); *A47L 9/0036* (2013.01); *A47L 9/248* (2013.01); *A47L 9/2884* (2013.01)

(58) Field of Classification Search
CPC ..... A47L 5/365; A47L 9/0036; A47L 9/248; A47L 9/2884
See application file for complete search history.

(56) References Cited

U.S. PATENT DOCUMENTS

2005/0166351 A1* 8/2005 Cunningham ..... H02K 7/14 15/314

FOREIGN PATENT DOCUMENTS

CN 203756560 U 8/2014
CN 203776830 U 8/2014
(Continued)

OTHER PUBLICATIONS

Machine Translation CN 209458188 (Year: 2020).*
CN-110215161-A—English Machine Translation (Year: 2019).*
Micronel U85 Radial Blower Sep. 17, 2017 (Year: 2017).*

*Primary Examiner* — Marc Carlson

(57) ABSTRACT

The disclosure provides a fan assembly and a vacuum cleaner with the fan assembly. The fan assembly includes a motor, an impeller and a fan housing. The impeller is driven by the motor, which includes an impeller air outlet and an impeller air inlet. The impeller air inlet is located in the axial direction of the impeller, and the impeller air outlet is located in the radial direction of the impeller. An air channel is formed inside the fan housing, and the impeller is at least partially housed in the fan housing. The impeller rotates relative to the fan housing about the rotational axis, the generated airflow enters the air channel during the rotation of the impeller, and the height of the fan housing in the direction of the rotational axis increases along the direction of the air flow.

14 Claims, 8 Drawing Sheets

(51) Int. Cl.
*A47L 9/24* (2006.01)
*A47L 9/28* (2006.01)

(56) References Cited

FOREIGN PATENT DOCUMENTS

| | | | | | |
|---|---|---|---|---|---|
| CN | 106989038 | A | | 7/2017 | |
| CN | 208973659 | U | | 6/2019 | |
| CN | 110215161 | A | * | 9/2019 | ..... A47L 11/24 |
| CN | 209458188 | U | * | 10/2019 | |
| CN | 112190172 | A | * | 1/2021 | ..... A47L 5/12 |
| DE | 19509163 | A1 | * | 9/1995 | ..... A47L 5/22 |
| EP | 2545766 | A1 | * | 1/2013 | ..... A01G 20/47 |

* cited by examiner

FAN ASSEMBLY AND VACUUM CLEANER WITH FAN ASSEMBLY

TECHNICAL FIELD

The disclosure relates to the technical field of vacuum cleaners, in particular to a fan assembly and a vacuum cleaner with the fan assembly.

BACKGROUND

Vacuum cleaner is a kind of electrical appliances commonly used in production and life, mainly used for cleaning and collecting dust and debris. The conventional vacuum cleaners on the market have good performance when cleaning up dust, garbage and other debris with low adsorption on the carpet and the ground. However, it is impossible to completely clean up the dust attached to the wall or the cracks or the debris with certain adhesion, which seriously affects users' experience of the conventional vacuum cleaner.

Therefore, it is necessary to further improve the conventional vacuum cleaner to solve the problems mentioned above.

SUMMARY

In view of this, a fan assembly and a vacuum cleaner with the fan assembly are provided to solve the problem that the conventional vacuum cleaner cannot completely clean up the dust attached to the wall or the cracks or the debris with certain adhesion.

The disclosure provides a fan assembly and the fan assembly includes a motor, an impeller and a fan housing. The impeller is driven by the motor, which includes an impeller air outlet and an impeller air inlet. The impeller air inlet is located in an axial direction of the impeller, and the impeller air outlet is located in a radial direction of the impeller. An air channel is defined inside the fan housing, and the impeller is at least partially housed in the fan housing. The impeller rotates relative to the fan housing about a rotational axis, a generated airflow enters the air channel during the rotation of the impeller, and a height of the fan housing in the direction of the rotational axis increases along the direction of the air flow.

In an embodiment of the disclosure, the fan housing includes an upper housing and a lower housing, the upper housing has an inverted U-shaped cross section along the direction of the rotational axis, and the lower housing is arranged below the upper housing and being a spiral air channel with the upper housing.

In an embodiment of the disclosure, the upper housing includes a first end, a spiral part spirally extending upward from the first end, and a second end located at an end of the spiral part, and base surfaces of the first end, the spiral part, and the second end are in a same plane.

In an embodiment of the disclosure, the lower housing includes a bottom wall and a side wall arranged along a circumferential direction of the bottom wall, and the side wall of the lower housing is connected with the side wall of the upper housing.

In an embodiment of the disclosure, a top surface of the spiral part is spiraling in the direction of the airflow.

In an embodiment of the disclosure, a top surface of the spiral part gradually spirally extends upward along a helix angle and the helix angle is between 3° and 35°.

In an embodiment of the disclosure, a ratio of a rated rotating speed of the impeller to a diameter of the impeller is not less than 220, and the rated rotating speed of the impeller is not less than 20000 rpm.

In an embodiment of the disclosure, the diameter of the impeller is between 60 mm and 80 mm.

The disclosure provides a vacuum cleaner, and the vacuum cleaner includes a housing, a dust suction assembly, a filter assembly, and a fan assembly. A dust collection cavity, a mounting cavity, and a through hole communicating the dust collection cavity and the mounting cavity are arranged in the housing. One end of the dust suction assembly passing through the housing and extending to the dust collection cavity. The filter assembly is arranged in the dust collection cavity. The fan assembly is arranged in the mounting cavity, and the fan assembly includes a motor, an impeller and a fan housing. The impeller is driven by the motor, and the impeller includes an impeller air outlet and an impeller air inlet. The impeller air inlet is located in an axial direction of the impeller and communicated with the through hole, and the impeller air outlet is located in a radial direction of the impeller. An air channel is formed inside the fan housing, and the impeller is at least partially housed in the fan housing. The impeller rotates relative to the fan housing about a rotational axis, a generated airflow enters the air channel during a rotation of the impeller, and a height of the fan housing in a direction of the rotational axis increases along a direction of the air flow.

In an embodiment of the disclosure, the housing includes a dust collector, a middle cover assembly and an upper cover assembly, the middle cover assembly is arranged above the dust collector and forms the dust collection cavity with the dust collector, the upper cover assembly is arranged above the middle cover assembly and forms the mounting cavity with the middle cover assembly.

In an embodiment of the disclosure, the fan housing includes an upper housing and a lower housing, the upper housing has an inverted U-shaped cross section along the direction of the rotational axis, and the lower housing is arranged below the upper housing and being a spiral air channel with the upper housing.

In an embodiment of the disclosure, the middle cover assembly includes a middle cover body and a recessed part formed through denting downwardly from the middle cover body, the through hole is arranged on an bottom wall of the recessed part, the fan assembly is housed in the recessed part, the recessed part is the lower housing of the fan housing, and a circular arc structure is formed at a position of the recessed part corresponding to the upper housing of the fan housing to guide high-pressure airflow around the impeller upwards into the air channel.

In an embodiment of the disclosure, the upper housing of the fan assembly includes a first end, a spiral part spirally extending upward from the first end, and a second end located at an end of the spiral part, and base surfaces of the first end, the spiral part, and the second end are in a same plane.

In an embodiment of the disclosure, a height of the spiral part close to the first end is lower than a height of the spiral part close to the second end, a top surface of the spiral part is spiraling along in the direction of the airflow.

In an embodiment of the disclosure, a top surface of the spiral part gradually spirally extends upward along a helix angle and the helix angle is a constant value.

In an embodiment of the disclosure, the helix angle is between 3° and 35°.

In an embodiment of the disclosure, the helix angle is 35°.

In an embodiment of the disclosure, the upper cover assembly includes a battery cavity housing a battery pack, a battery pack cover is arranged on an upper part of the battery cavity, and the battery pack cover is movably connected with the upper cover assembly.

In an embodiment of the disclosure, the dust suction assembly is arranged on the upper cover assembly, the dust suction assembly includes a throat pipe and a dust suction accessory connected to the throat pipe, the throat pipe includes a soft throat pipe and a hard throat pipe arranged on both sides of the soft throat pipe, a first side of the soft throat pipe is fixed on the upper cover assembly through the hard throat pipe, and a second side of the soft throat pipe is connected to the dust suction accessory through the hard throat pipe.

In an embodiment of the disclosure, the upper cover assembly further includes an accessory groove housing the dust suction accessory.

In an embodiment of the disclosure, the upper cover assembly is provided with a fixing component to fix the hard throat pipe and a groove to house the soft throat pipe, the fixing component is a circular arc-shaped gasket, as in a storing state, the hard throat pipe at the second side is located on the gasket to match the groove to fix and limit the throat pipe.

In an embodiment of the disclosure, the upper cover assembly is provided with an air inlet communicated with the dust suction assembly, and an air outlet is arranged between the middle cover assembly and the upper cover assembly.

In an embodiment of the disclosure, the motor is a brushless motor.

In an embodiment of the disclosure, the brushless motor includes a fan blade for heat dissipation, and the fan blade is arranged between the brushless motor and the impeller.

In an embodiment of the disclosure, a ratio of a rated rotating speed of the impeller to a diameter of the impeller is not less than 220, and the rated rotating speed of the impeller is not less than 20000 rpm.

In an embodiment of the disclosure, the diameter of the impeller is between 60 mm and 80 mm.

In summary, the fan assembly of the disclosure is provided with a spiral air channel in the fan housing, so that when the motor rotates, the fan blade can be driven to rotate and a high-pressure airflow is formed at the top of the fan blade. Then the high-pressure airflow flows out along the spiral air channel in the fan housing. The spiral air channel is beneficial to reduce wind pressure loss and wind resistance, increase air flow, and improve the suction effect and working efficiency of the vacuum cleaner to a certain extent.

BRIEF DESCRIPTION OF THE DRAWINGS

In order to explain the embodiments of the disclosure or the technical solutions in the conventional art more clearly, the following will briefly introduce the drawings that need to be used in the description of the embodiments or the conventional art. Obviously, the drawings in the following description are only some embodiments of the disclosure. For those of ordinary skill in the art, other drawings can be obtained based on these drawings without creative work.

DETAILED DESCRIPTION

Figure 1:
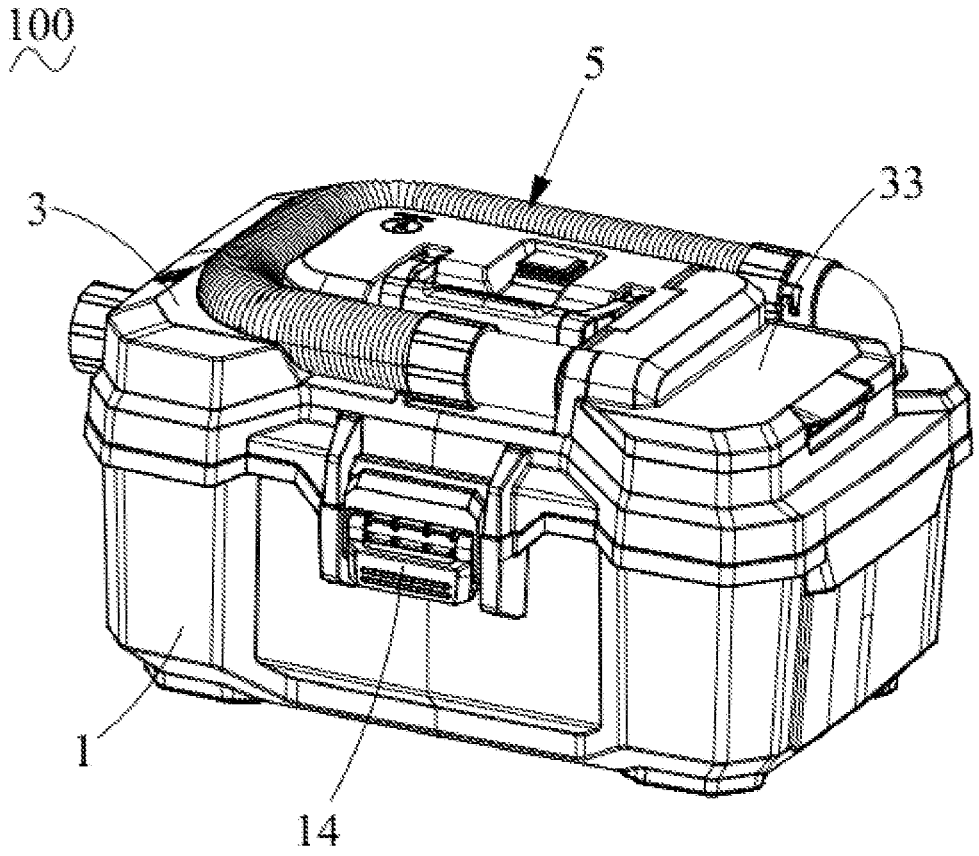
FIG. 1 is a perspective view of a vacuum cleaner of the disclosure.

The following describes the implementation of the disclosure through specific embodiments, and those skilled in the art can easily understand other advantages and effects of the disclosure from the content disclosed in this specification. The disclosure can also be implemented or applied through other different specific embodiments. Various details in this specification can also be modified or changed based on different viewpoints and applications without departing from the spirit of the disclosure. It should be noted that, the following embodiments and the features in the embodiments can be combined with each other without conflict. It should further be understood that the terms used in the examples of the disclosure are used to describe specific embodiments, instead of limiting the protection scope of the disclosure. The test methods that do not indicate specific conditions in the following examples are usually in accordance with conventional conditions, or conditions recommended by each manufacturer.

It should be noted that the structure, scale, size, etc. of the drawings in this specification are merely for illustration of the disclosed content for understanding and reading by those skilled in the art, and do not intend to limit the restrictive conditions under which the disclosure can be implemented, so it has no technical significance. Any structural modification, proportional relationship change or size adjustment should still be within the scope of the technical content disclosed in the disclosure, without affecting the effects and objectives that can be achieved by the disclosure. At the same time, the terms such as "upper", "lower", "left", "right", "middle" and "one" cited in this specification are only for the convenience of description and are not used to limit the scope of the disclosure. The change or adjustment of the relative relationship should also be regarded as the applicable scope of the disclosure without substantial change in the technical content.

The disclosure provides a fan assembly and a vacuum cleaner with the fan assembly. The vacuum cleaner can improve the suction effect to a certain extent, which improves work efficiency.

Please refer to FIG. 1 to FIG. 4 and FIG. 9. The disclosure provides a vacuum cleaner 100, the vacuum cleaner 100 includes a housing, a dust suction assembly 5, a filter assembly 4 and a fan assembly 6. The housing is provided with a dust collection cavity 13, a mounting cavity 24, and a through hole 221 communicating the dust collection cavity 13 and the mounting cavity 24. The dust suction assembly 5 is arranged on the housing and communicates with the dust collection cavity 13. The filter assembly 4 is arranged in the dust collection cavity 13. The fan assembly 6 is installed in the mounting cavity 24.

Please refer to FIG. 1 through FIG. 6, the housing includes a dust collector 1, a middle cover assembly 2 arranged above the dust collector 1 and an upper cover assembly 3 covering the middle cover assembly 2. A dust collection cavity 13 is formed between the dust collector 1 and the middle cover assembly 2, and a mounting cavity 24 is formed between the upper cover assembly 3 and the middle cover assembly 2. The upper cover assembly 3 is provided with an air inlet 30 communicating with the dust suction assembly 5, and an air outlet 30' is arranged between the middle cover assembly 2 and the upper cover assembly 3. The dust collector 1 is capable of being made into various shapes. In one embodiment, the dust collector 1 is rectangular and includes a bottom wall 11 and a side wall 12 for connecting the bottom wall 11 and the middle cover assembly 2. The side walls 12 are provided with four and jointly define a housing space with the bottom wall 11. The middle cover assembly 2 protrudes into the housing space and forms a dust collection cavity 13 with it, and the filter assembly 4 is housed in the dust collection cavity 13. The fan assembly 6 is arranged in the mounting cavity 24 between the middle cover assembly 2 and the upper cover assembly 3 and communicates with connecting the dust collector 1. The side wall 12 of the dust collector 1 is also provided with a connecting part 14 for connecting and fixing the middle cover assembly 2 and the upper cover assembly 3. In this embodiment, the connecting part 14 is configured as a movable buckle, so that the middle cover assembly 2 and the upper cover assembly 3 are detachably fixed on the dust collector 1.

Figure 2:
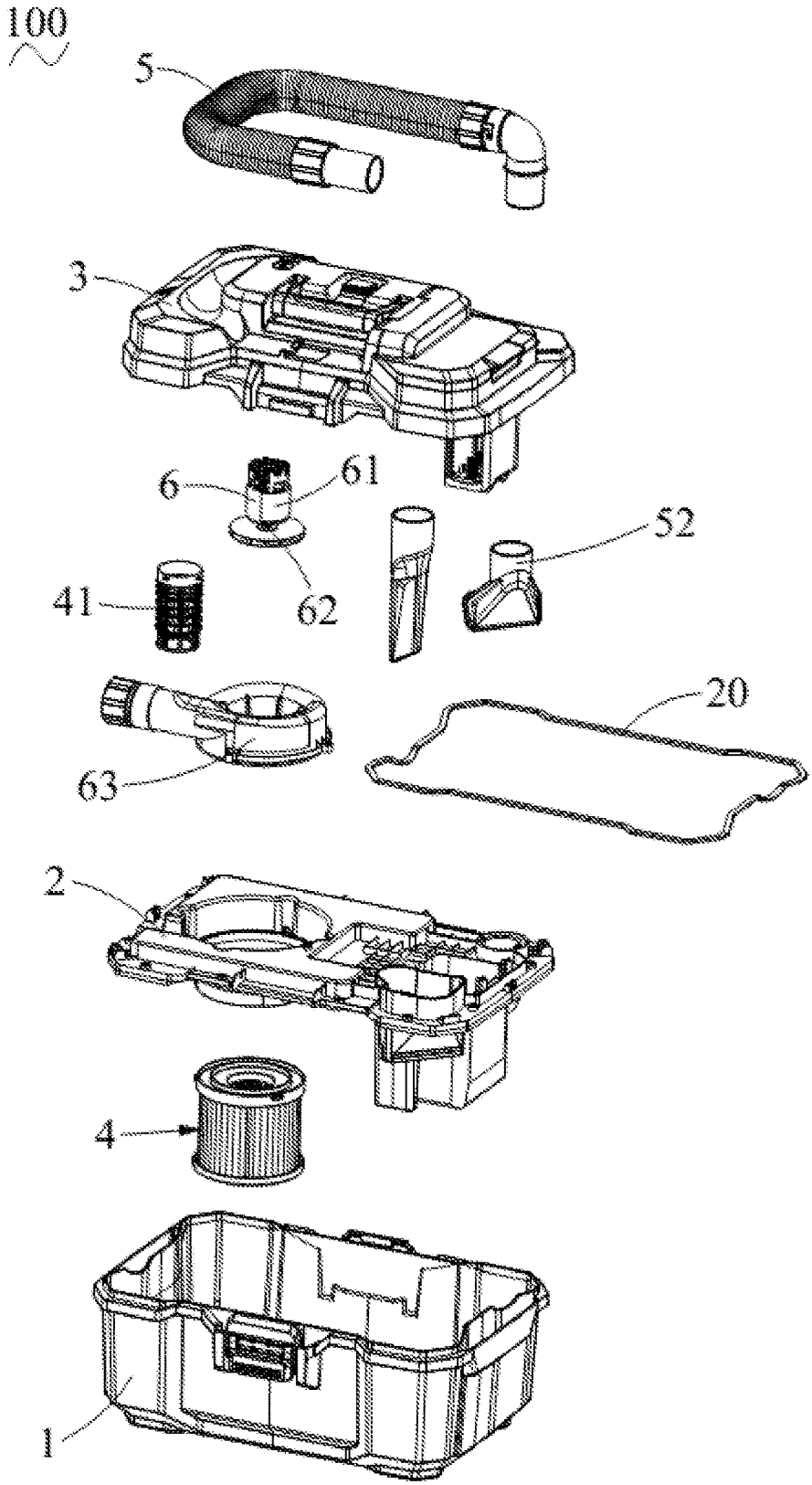
FIG. 2 is an exploded view of the vacuum cleaner shown in FIG. 1.
Figure 3:
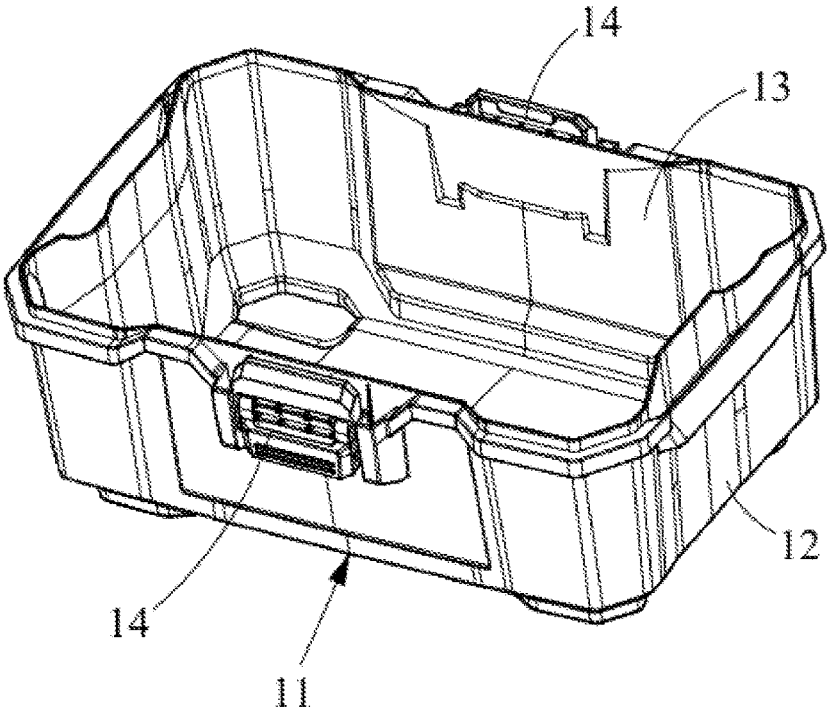
FIG. 3 is a perspective view of a dust collector in FIG. 2.
Figure 4:
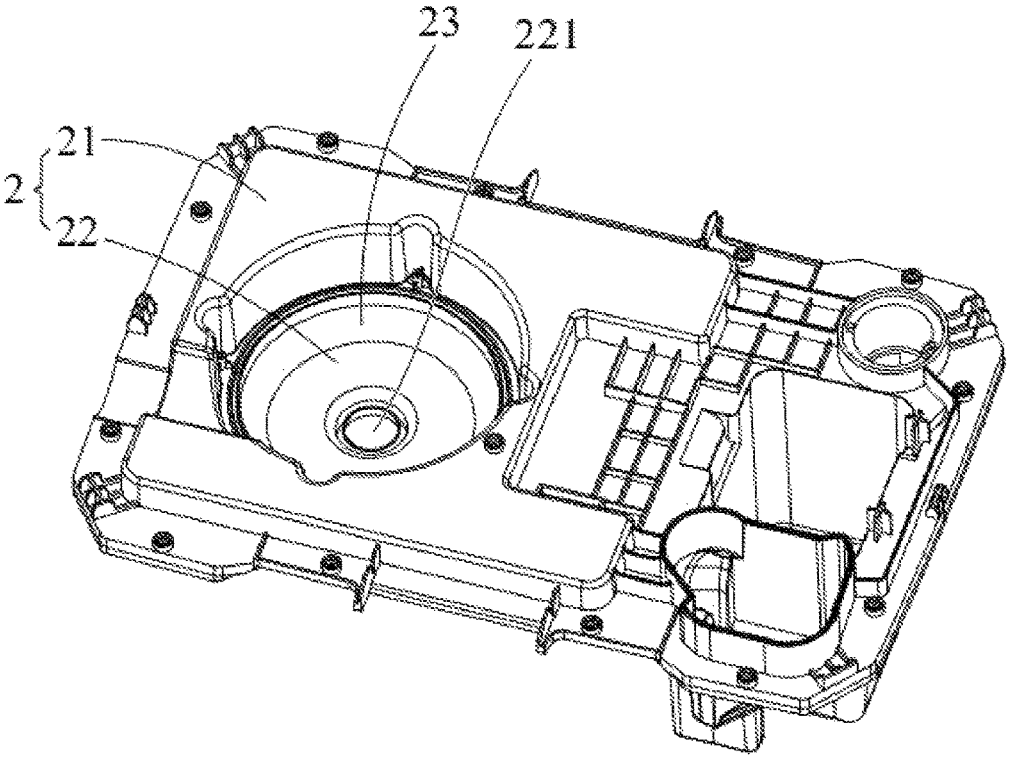
FIG. 4 is a perspective view of a middle cover assembly in FIG. 2.
Figure 5:
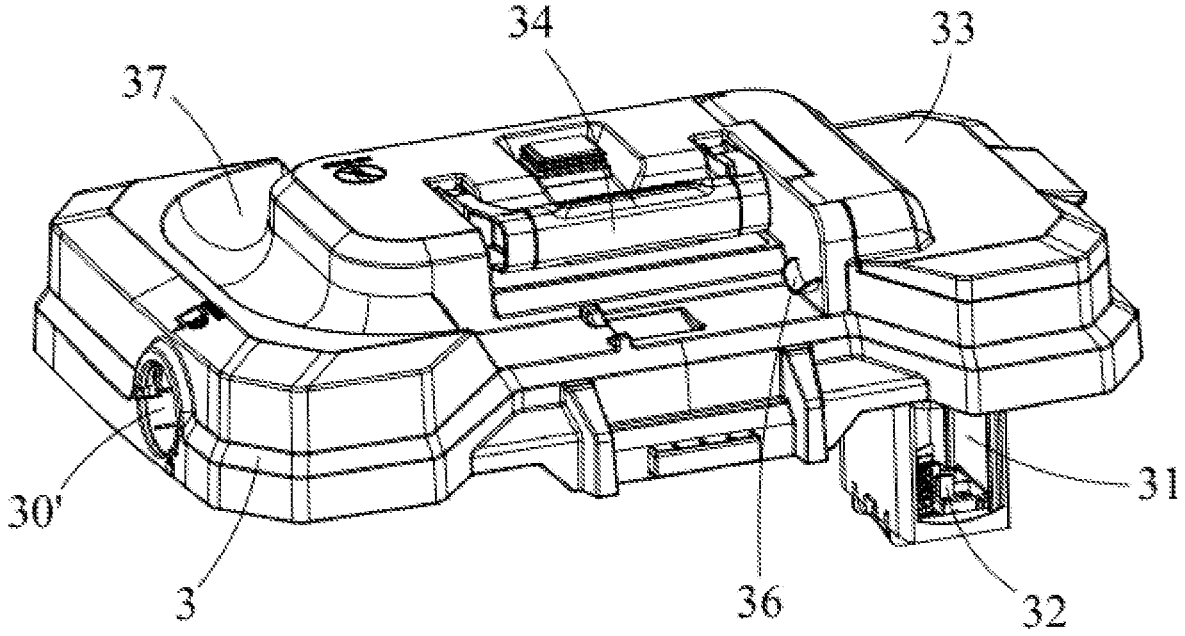
FIG. 5 is a perspective view of an upper cover assembly in FIG. 2.
Figure 6:
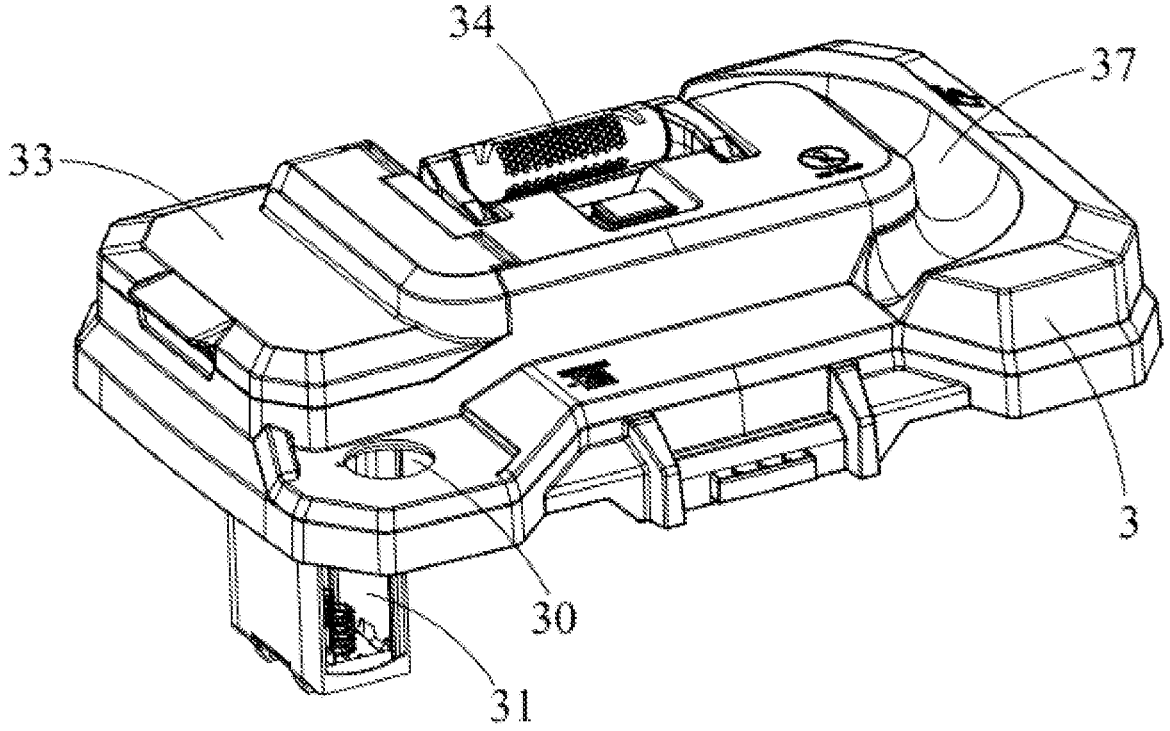
FIG. 6 is another perspective view of the upper cover assembly shown in FIG. 5.

Please refer to FIG. 2 and FIG. 4, the middle cover assembly 2 includes a middle cover body 21 arranged on the dust collector 1 and a recessed part 22 denting from the middle cover body 21 toward the inside of the dust collector 1. In addition, the bottom wall of the recessed part 22 is provided with a through hole 221 for communicating the dust collection cavity 13 and the mounting cavity 24. In this embodiment, the middle cover assembly 2 is embedded and fixed on the dust collector 1, and a sealing ring 20 is also arranged between the middle cover assembly 2 and the dust collector 1 to ensure that the middle cover assembly 2 and the dust collector 1 are arranged tightly and prevent air from escaping into the dust collector 1 from the gap between mounting positions of the middle cover assembly 2 and the dust collector 1 due to the pressure difference during the working process of the vacuum cleaner 100, which ensures the working efficiency of the vacuum cleaner 100. Specifically, during the assembly process of the vacuum cleaner 100 of the disclosure, at first, the middle cover assembly 2 is fixed on the dust collector 1. Secondly, the upper cover assembly 3 is used to cover on the middle cover assembly 2. At last, the connecting part 14 is fastened to fix the middle cover assembly 2 and the upper cover assembly 3 on the dust collector 1, which ensures that the upper cover assembly 3 and the middle cover assembly 2 are stably connected with the dust collector 1 during the working process.

Please refer to FIG. 2, FIG. 5, FIG. 6 and FIG. 8, the upper cover assembly 3 is used to cover on the middle cover assembly 2 and is detachably connected with the dust collector 1 through the connecting part 14. A battery cavity 31 for housing a battery pack 200 is formed in the upper cover assembly 3, a battery insert 32 is arranged in the battery cavity 31, and the battery insert 32 is arranged corresponding to the battery pack 200. The battery cavity 31 is formed through denting from a top of the upper cover assembly 3 toward the dust collector 1 (downward). Correspondingly, the position of the middle cover assembly 2 corresponding to the battery cavity 31 is recessed in the direction of the dust collector 1 to receive the battery cavity 31, and the battery cavity 31 is arranged on a different side of the recessed part 22 of the middle cover assembly 2. With this arrangement, a motor 61 and the battery pack 200 are respectively located at two ends of the vacuum cleaner 100, so that the center of gravity of the vacuum cleaner 100 is approximately at the center of the housing, thereby avoiding the problem that the vacuum cleaner 100 is difficult to carry due to one side being too heavy. The battery pack 200 is housed in the battery cavity 31 and plugged on the battery insert 32 to provide power to the vacuum cleaner 100. An upper part of the battery cavity 31 is provided with a battery pack cover 33 covering the battery cavity 31, and the battery pack cover 33 is movably connected with the upper cover assembly 3. In this embodiment, the battery pack cover 33 and the upper cover assembly 3 are pivotally connected, and it can be understood that the connection method is not limited to this. With this arrangement, the battery pack 200 of the vacuum cleaner 100 of the disclosure is capable of being mounted and removed only through opening the battery pack cover 33, which improves the convenience to use the vacuum cleaner 100. The upper cover assembly 3 is further provided with a handle 34, and the handle 34 is capable of being freely rotated on the upper cover assembly 3 to facilitate the use and movement of the vacuum cleaner 100.

Figure 7:
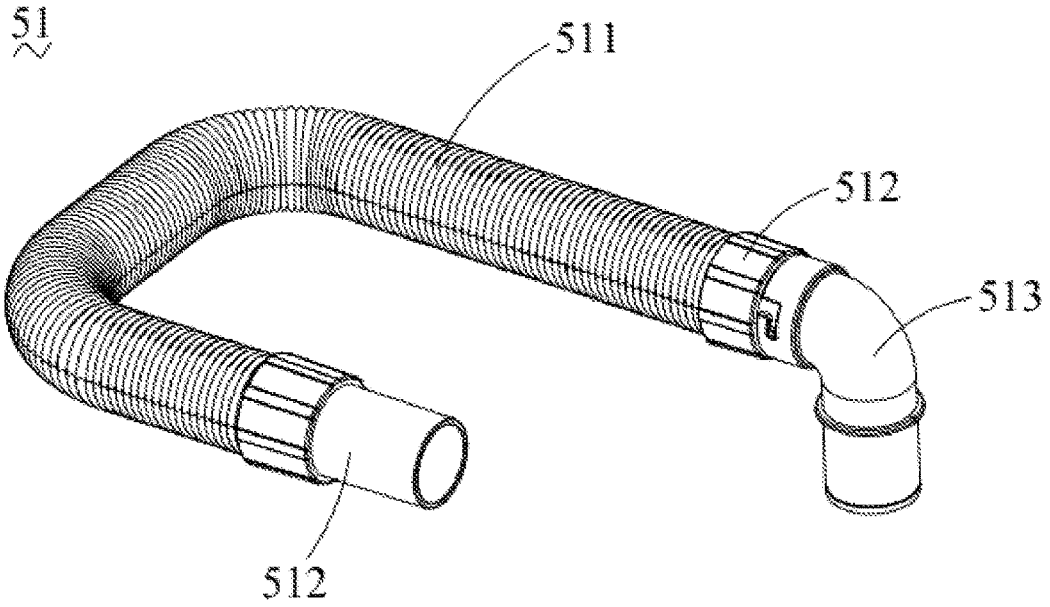
FIG. 7 is a perspective view of a dust suction assembly in FIG. 2.
Figure 8:
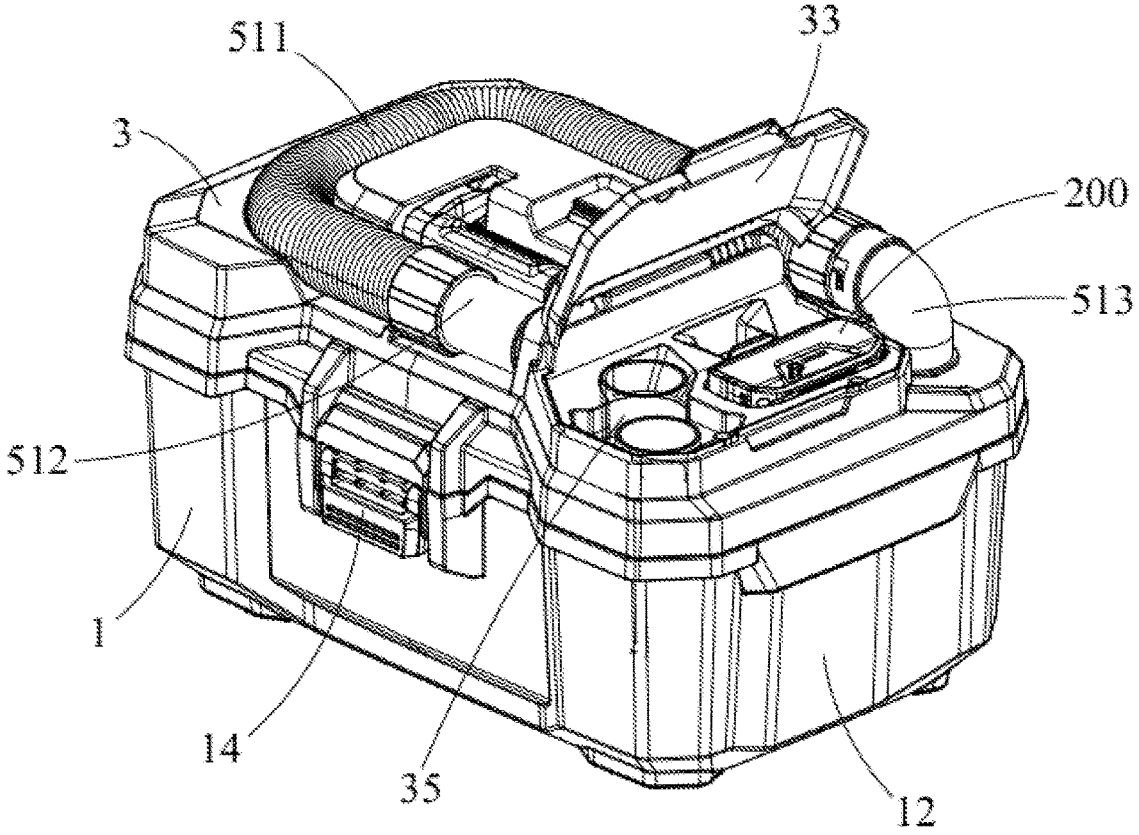
FIG. 8 is a state view when a battery pack cover of the vacuum cleaner shown in FIG. 1 is opened.

Please refer to FIG. 2 and FIG. 7, the dust suction assembly 5 includes a throat pipe 51 and a dust suction accessory 52 connected with the throat pipe 51. The throat pipe 51 includes a soft throat pipe 511 and a hard throat pipe 512 arranged on both sides of the soft throat 511. A first side of the soft throat pipe 511 is fixed on the upper cover assembly 3 through the hard throat pipe 512 and a connecting part 513, and a second side is connected to the dust suction accessory 52 through the hard throat pipe 512, so that the throat pipe 51 is capable of working through the dust suction accessory 52. The dust suction accessory 52 is capable of being a commonly used accessory of the vacuum cleaner 100 such as a floor brush, a flat vacuum, a round brush, a bed sheet brush, a sofa vacuum and so on, which means that the dust suction accessory 52 is capable of being selected and replaced according to the location where the vacuum cleaner 100 is used, and it is not limited here.

Please refer to FIG. 2, FIG. 5 through FIG. 8, an accessory groove 35 for housing the dust suction accessory 52 is further formed in the upper cover assembly 3, and the accessory groove 35 is recessed from the top of the upper cover assembly 3 toward the dust collector 1. Preferably, the accessory groove 35 is located beside the battery cavity 31 and is simultaneously covered by the battery pack cover 33. With this arrangement, not only the dust suction accessory 52 can be stored well, be convenient for storage and avoid damage, but also it is convenient for access. Under the condition that the connection between the upper cover assembly 3 with the middle cover assembly 2 and the dust collector 1 is maintained, the dust suction attachment 52 is capable of being replaced as needed. The upper cover assembly 3 is also provided with a fixing component 36 for fixing the hard throat 512 and a groove 37 for housing the soft throat 511. The groove 37 is formed through denting downwardly from an upper surface of the upper cover assembly 3. The fixing component 36 is an arc-shaped gasket. In the storage state, the hard throat pipe 512 at the second side is placed on the gasket 36 to match the groove 37 to jointly fix and limit the throat pipe 51, which makes the throat 51 be fixed on the upper cover assembly 3.

Please refer to FIG. 2, FIG. 4 and FIG. 10 through FIG. 13, the fan assembly 6 includes a motor 61, an impeller 62 and a fan housing. The impeller 62 is arranged on the output shaft of the motor 61 and is driven by the motor 61. The impeller 62 includes an impeller air outlet 622 and an impeller air inlet 621. The impeller air inlet 621 is located in the axial direction of the impeller 62 and is communicated with the through hole 221. The impeller air outlet 622 is located in the radial direction of the impeller 62. An air channel 631 is formed in the fan housing, the impeller 62 is at least partially housed in the fan housing, and a height of the fan housing in the direction of a rotational axis increases along the direction of the airflow. In an embodiment, the fan assembly 6 is arranged in the recessed part 22 of the middle cover assembly 2. Specifically, the motor 61 is placed vertically. The impeller 62 is connected to the motor shaft 611 of the motor 61, and the impeller 62 is housed in the recessed part 22. The impeller air inlet 621 is located on the axis of the impeller 62 and is directly opposite to the through hole 221 on the bottom wall of the recessed part 22. The outlet direction of the impeller air outlet 622 is perpendicular to the axis of the impeller 62. Therefore, when the motor 61 rotates, the impeller 62 is driven to rotate and a high pressure area is formed at a top of the impeller 62, so that the airflow moves from a low pressure area to a high pressure area, and a spiral upward airflow direction with the vertical direction as an axis is generated at the position of the fan assembly 6. The fan housing includes an upper housing 63 and a lower housing. The upper housing 63 is a ring-shaped structure, and the bottom thereof is in a shape of an opening, so that the cross section in the direction of the rotational axis of upper housing 63 of the fan housing is in an inverted U-shape. An inner side wall 633 of the upper housing 63 is connected by a connecting plate 635, and the connecting plate 635 is provided with a through hole for the motor shaft 611 to pass through. The lower housing includes a bottom wall and side walls arranged in the circumferential direction along the bottom wall. The side walls of the lower housing are connected with outer side walls 634 of the upper housing 63, so that the upper housing 63 and the lower housing form an air channel 631. In this embodiment, the bottom wall of the recessed part 22 of the middle cover assembly is the lower housing of the fan housing, and the air channel 631 is formed by the combination of the upper housing 63 of the fan housing and the bottom wall of the recessed part 22 of the middle cover assembly 2. Preferably, a circular arc structure 23 is formed at the position of the recessed part 22 corresponding to the upper housing 63 of the fan housing, and the circular arc structure 23 is used to guide high-pressure airflow around the impeller 62 upwards into the air channel 631. In other embodiments, the lower housing can also be set up separately, so that an air channel 631 is formed between the upper housing 63 and the lower housing, which is not limited to this.

Figure 9:
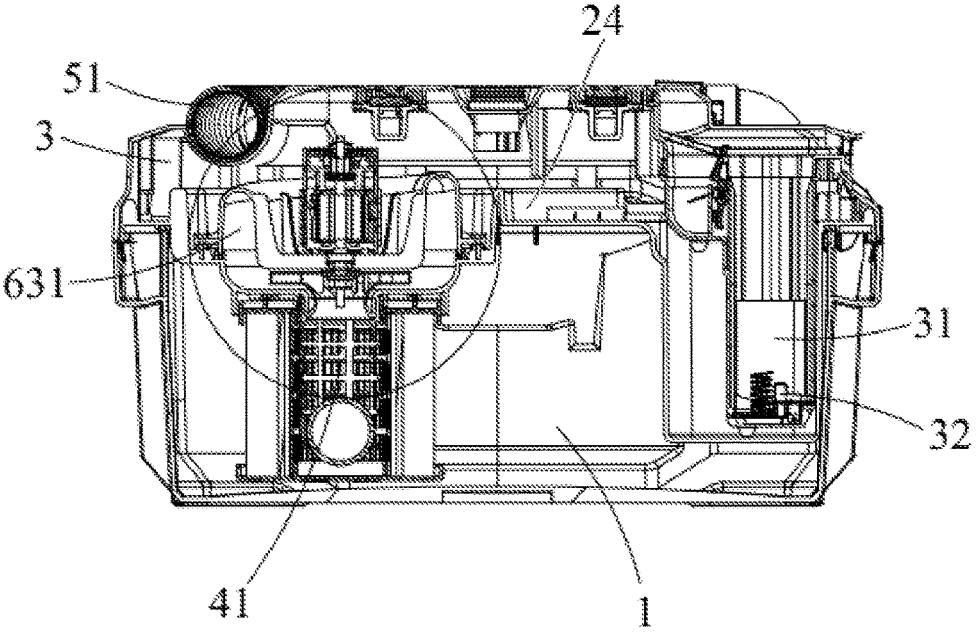
FIG. 9 is a cross-sectional view of the vacuum cleaner shown in FIG. 1.
Figure 10:
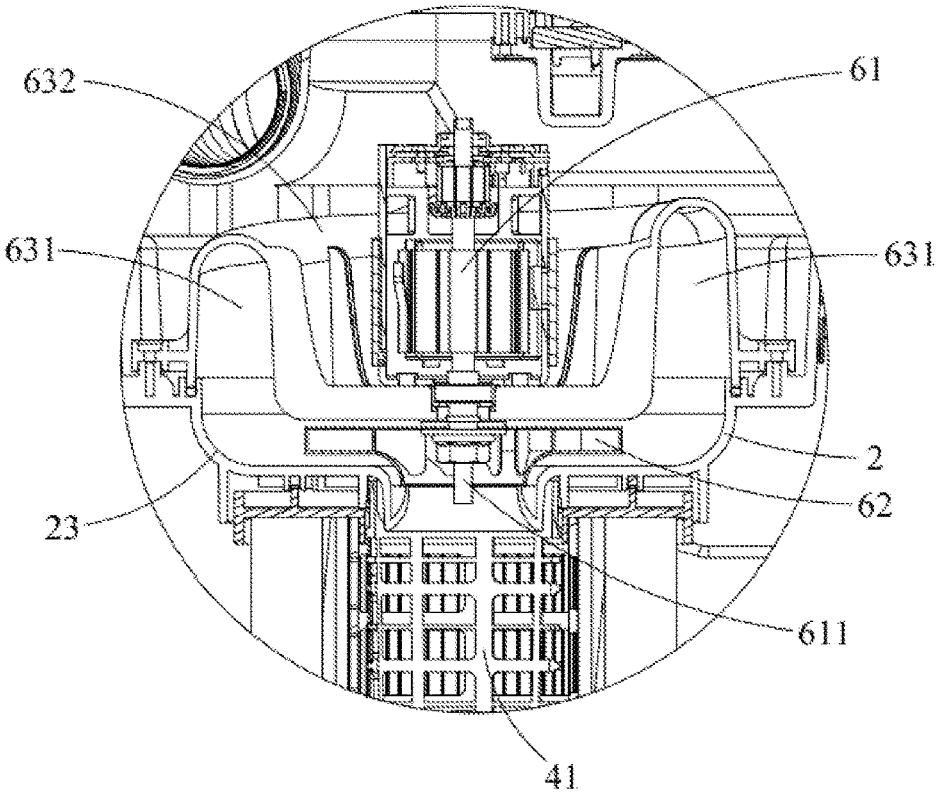
FIG. 10 is a partial enlarged view of a circle shown in FIG. 9.
Figure 11:
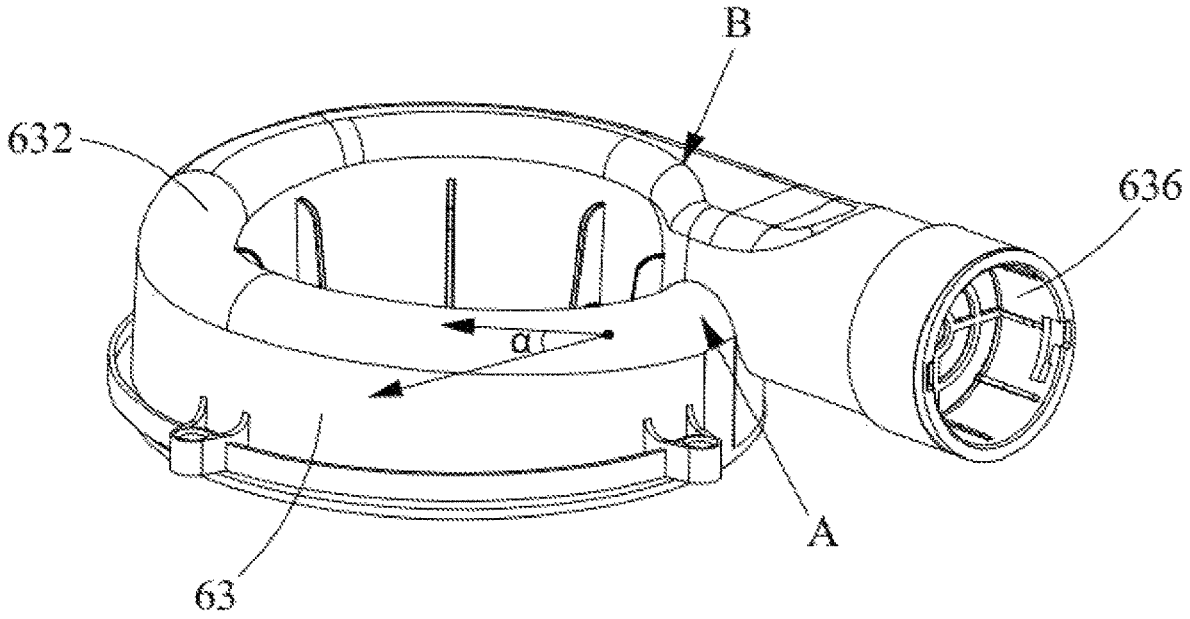
FIG. 11 is a perspective view of a fan housing in FIG. 2.
Figure 12:
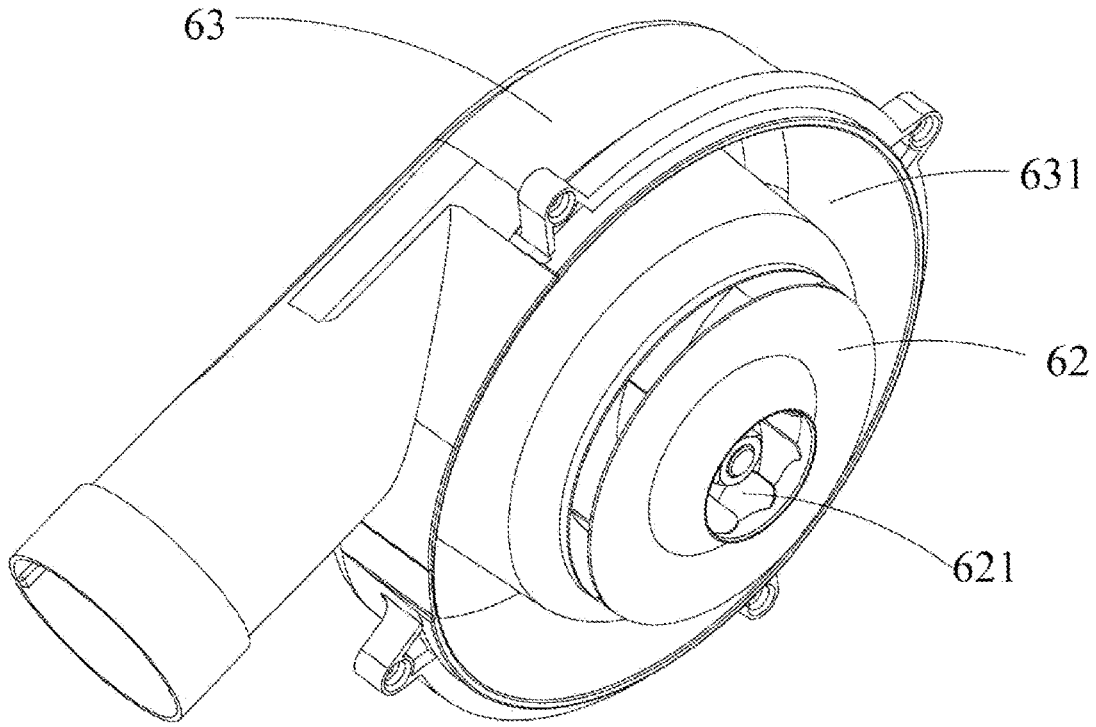
FIG. 12 is a perspective view of the fan housing in FIG. 2 from another angle.

Please refer to FIG. 9 through FIG. 11, the upper housing 63 of the fan housing is provided with a first end A, a spiral part 632 spirally extending upward from the first end A, and a second end B located at the end of the spiral part 632. In other words, the spiral part 632 spirals from the first end A to the second end B until the first end A and the second end B merge. At this time, a round of spiral is completed. A fan air outlet 636 is arranged at the second end B of the upper housing 63 of the fan housing. The fan air outlet 636 communicates with the air outlet 30'. The high-pressure airflow spirally flows in the air channel 631 and is finally discharged from the air outlet 30'. After the high-pressure airflow is discharged from the air outlet 30', a negative pressure is formed inside the dust suction assembly 5, which encourages external air to enter the soft throat pipe 511 from the dust suction accessory 52, and the function of the vacuum cleaner 100 is completed at this time. In this embodiment, the base surfaces of the first end A, the spiral part 632, and the second end B are in the same plane, and the height of the spiral part 632 close to the first end A is lower than the height of the spiral part 632 close to the second end B, so that the top surface of the spiral part 632 is spiral. The top surface of the spiral part 632 is designed as a spiral shape to form a spiral air channel 631 inside the fan housing. Of course, in other embodiments, the overall height of the spiral part 632 may be kept constant, and then a groove is formed at the bottom of the spiral part 632 to form a spiral air channel 631, which is not limited here. In this embodiment, the top surface of the spiral part 632 gradually spirally extends upward along the helix angle $\alpha$. The helix angle $\alpha$ is preferably a constant angle. As shown in FIG. 11, the helix angle $\alpha$ is the angle between a tangent of the helix on the top surface and a plane perpendicular to a helix axis (i.e., the horizontal plane). In this embodiment, the helix angle is one of the important parameters that affect the wind resistance of the air channel and the work efficiency.

Table 1 shows that the upper housings 63 of the fan housing with different helix angles are applied to the vacuum cleaner 100. When the vacuum cleaner 100 is working normally (which means when the working voltage remains the same), current, shaft power, fluid power, flow, total pressure and work efficiency will be analyzed and then specific values can be obtained. The specific values are shown in the table below.

TABLE 1

| helix angle ° | voltage V | current A | Shaft power W | fluid power W | flow l/s | total pressure KPa | work efficiency % |
|---|---|---|---|---|---|---|---|
| 3° | 36.0 | 9.17 | 330 | 95 | 10.5 | 7.2 | 28.8% |
| 8° | 36.0 | 8.53 | 307.1 | 98.2 | 11.7 | 8.4 | 32% |
| 12° | 36.0 | 9.35 | 336.6 | 108.3 | 11.2 | 9.67 | 32.2% |
| 20° | 36.0 | 8.55 | 307.8 | 101 | 11.7 | 8.6 | 32.8% |
| 35° | 36.0 | 8.89 | 320 | 108 | 12.1 | 8.9 | 34% |

It can be seen from the above table: under the voltage of 36V, the helix angle is set between 3° to 35°. When the helix angle is 3°, the working efficiency of the vacuum cleaner 100 reaches 28.8%, and when the helix angle is 8°, the working efficiency of the vacuum cleaner 100 reaches 32%. At this time, the current value, the shaft power and the total voltage are all low. When the helix angle is 12°, the working efficiency of the vacuum cleaner 100 is 32.2%, and the current value, the shaft power, the fluid power and the total pressure are all high at this time. When the helix angle is 20°, the working efficiency of the vacuum cleaner 100 is 32.8%. When the helix angle is 35°, the working efficiency of the vacuum cleaner 100 reaches 34%, which is the highest value, and at the same time the flow also reaches the maximum. From this data, it can be concluded that under the same voltage, when the helix angle of the spiral part 632 is between 3 degrees to 35 degrees, the working efficiency of the vacuum cleaner 100 will gradually increase and reach the highest value when the helix angle is 35°. Therefore, the helix angle of the top surface of the spiral part 632 is preferably 3 degrees to 35 degrees. Such a design is beneficial to reduce wind pressure loss and wind resistance, improve air flow, and increase work efficiency by about 10% to a certain extent.

Figure 13:
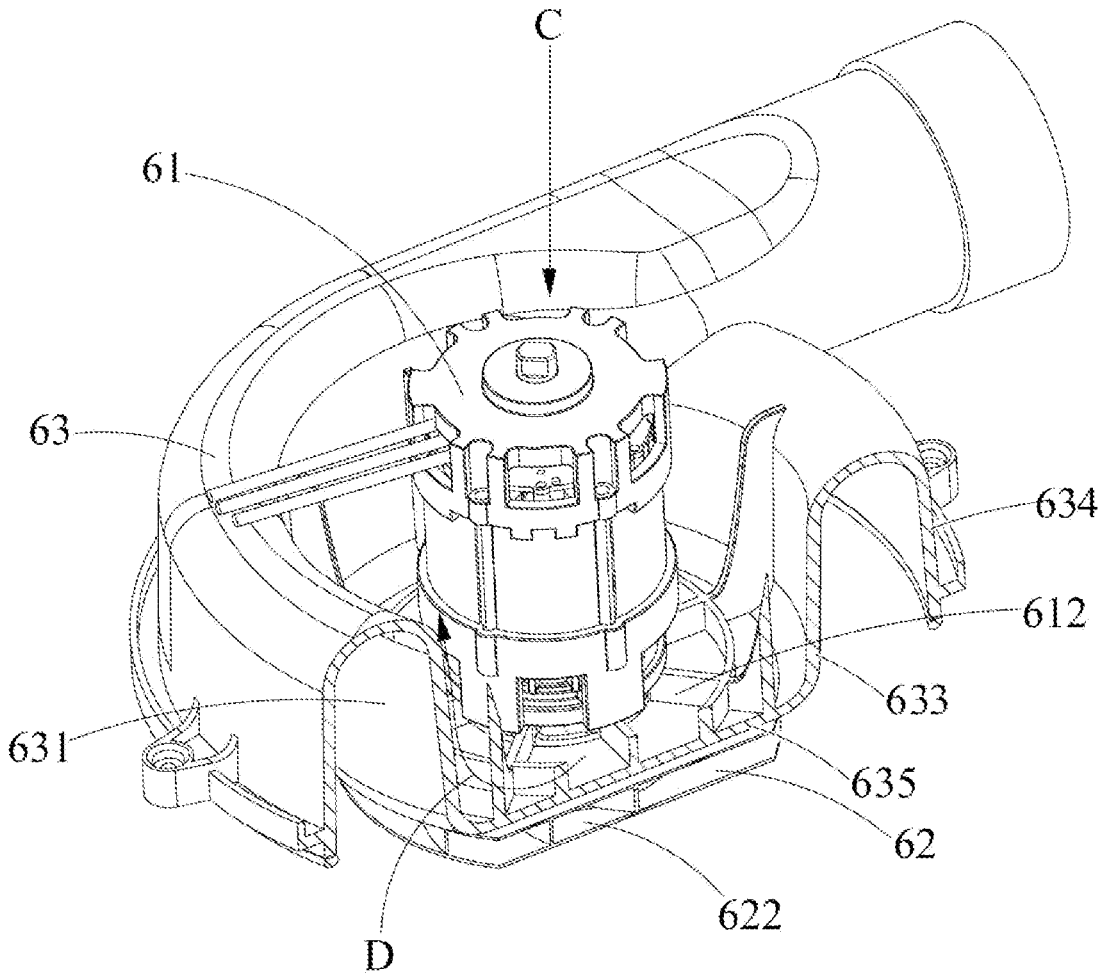
FIG. 13 is a cross-sectional view of a fan assembly in FIG. 2.

Please refer to FIG. 13, in one embodiment, the motor 61 can be selected as a brushless motor. The brushless motor is not provided with brushes, so that the brushless motor can rotate at a high speed with low noise. Secondly, the volume of the brushless motor is smaller, which can free up more space for housing the battery assembly and extend the endurance time of the vacuum cleaner 100. The brushless motor is also provided with a fan blade 612 for heat dissipation. The fan blade 612 is located between the brushless motor and the impeller 62. When the brushless motor is working, the fan blade 612 is driven by the brushless motor to rotate, thereby driving wind from an end of the brushless motor away from the fan blade 612 into the brushless motor. Then the wind is discharged from the gap between the brushless motor and the recessed part 22 of the middle cover assembly 2, which means that the cooling wind enters the brushless motor along the direction C, and then exits along the direction D, so that heat is dissipated from the brushless motor. In other embodiments, the fan blade 612 is also capable of being arranged at the end of the brushless motor away from the impeller 62, the cooling wind is introduced into the brushless motor along the direction C, and then discharged along the direction D. Or the cooling wind enters the brushless motor along the opposite direction of the direction D, and then exits along the opposite direction of the direction C.

The rated rotating speed of the impeller 62 is set between 20,000 rpm to 80,000 rpm, and the diameter of the impeller 62 is set between 60 mm and 90 mm. With this arrangement, the total pressure efficiency of the vacuum cleaner 100 is relatively high, so that the dust suction efficiency of the vacuum cleaner 100 can be improved. The rotating speed of the impeller 62 may also be greater than 80,000 rpm, and the diameter of the impeller 62 may be less than 60 mm or greater than 90 mm, which is not a limited herein. Preferably, the diameter of the impeller 62 is between 60 mm to 80 mm. When the rated rotating speed of the impeller 62 is set to 40,000 rpm, and the diameter of the impeller 62 is set to 70 mm, the impeller 62 has the highest total pressure efficiency at this time. Preferably, the diameter of the impeller 62 is set to 60 mm. With this arrangement, when the rotating speed of the impeller 62 is between 20,000 rpm to 80,000 rpm, the vacuum cleaner 100 has a better total pressure efficiency, so that the fan suction assembly 6 is capable of being applied widely.

Please refer to FIG. 2 and FIG. 10, the filter assembly 4 includes a filter element 41. The filter element 41 is fixedly arranged in the dust collection cavity 13 formed by the dust collector 1 and the middle cover assembly 2, located below the impeller 62, and communicates with the through hole 221 in the bottom wall of the recessed part 22 of the middle cover assembly 2, so that when the impeller 62 rotates, the filtered gas will be sucked into the impeller 62 and a high-pressure airflow is formed at the top of the impeller 62, which makes the high-pressure airflow flows out along the spiral air channel 631 inside the fan housing. Since the specific structure of the filter assembly 4 can adopt conventional technical solutions, it will not be repeated here.

In summary, the air flow direction of the vacuum cleaner 100 of the disclosure is: the air flow carries impurities into the dust collector 1 through the dust suction accessory 52, the throat pipe 51 and the air inlet 30. After filtered by the filter assembly 4, the impurities will fall into the dust collector 1. The air flow continues to flow along the spiral air channel 631 in the fan housing, so that when the motor 61 rotates, the impeller 62 can be driven to rotate and a high-pressure air flow can be formed at the top of the impeller 62. Then the high-pressure air flows out from the air outlet 30' along the spiral air channel 631 in the fan housing. The spiral air channel 631 is beneficial to reduce wind pressure loss and wind resistance, improves air flow, and improves suction effect and working efficiency of the vacuum cleaner 100 to a certain extent.

The above embodiments are only used to illustrate the technical solutions of the disclosure and not to limit them. Although the disclosure has been described in detail with reference to preferred embodiments, those of ordinary skill in the art should understand that the technical solutions of the disclosure can be modified or equivalently replaced without departing from the spirit and scope of the technical solutions of the disclosure.

What is claimed is:

1. A vacuum cleaner, comprising:

a housing, wherein a dust collection cavity, a mounting cavity, and a through hole communicating the dust collection cavity and the mounting cavity are arranged in the housing, a dust suction assembly, one end thereof passing through the housing and extending to the dust collection cavity, a filter assembly, arranged in the dust collection cavity, and a fan assembly, arranged in the mounting cavity, comprising:

an impeller, driven by a motor, the impeller comprising an impeller air inlet located in an axial direction of the impeller and communicated with the through hole, and an impeller air outlet located in a radial direction of the impeller, and a fan housing, defining an air channel therein, the impeller being at least partially housed in the fan housing, the impeller rotating relative to the fan housing about a rotational axis, a generated airflow entering the air channel during a rotation of the impeller, and a height of the fan housing in a direction of the rotational axis increasing along a direction of the air flow;

wherein, the housing comprises a dust collector, a middle cover assembly and an upper cover assembly, the middle cover assembly is arranged above the dust collector and forms the dust collection cavity with the dust collector, the upper cover assembly is arranged above the middle cover assembly and forms the mounting cavity with the middle cover assembly;

the upper cover assembly comprises a battery cavity housing a battery pack, a battery pack cover is arranged on an upper part of the battery cavity, and the battery pack cover is movably connected with the upper cover assembly.

2. The vacuum cleaner according to claim 1, wherein the fan housing comprises an upper housing and a lower housing, the upper housing has an inverted U-shaped cross section along the direction of the rotational axis, and the lower housing is arranged below the upper housing and being a spiral air channel with the upper housing.

3. The vacuum cleaner according to claim 2, wherein the middle cover assembly comprises a middle cover body and a recessed part denting downwardly from the middle cover body, the through hole is arranged on a bottom wall of the recessed part, the fan assembly is housed in the recessed part, the bottom wall of the recessed part is the lower housing of the fan housing, and a circular arc structure is formed at a position of the recessed part corresponding to the upper housing to guide high-pressure airflow around the impeller upwards into the air channel.

4. The vacuum cleaner according to claim 2, wherein the upper housing of the fan assembly comprises a first end, a spiral part spirally extending upward from the first end, and a second end located at an end of the spiral part, and base surfaces of the first end, the spiral part, and the second end are in a same plane.

5. The vacuum cleaner according to claim 4, wherein a height of the spiral part close to the first end is lower than a height of the spiral part close to the second end, and a top surface of the spiral part is spiraling in the direction of the airflow, the top surface of the spiral part gradually spirally extends upward along a helix angle and the helix angle is a constant value, and the helix angle is between 3° and 35°.

6. The vacuum cleaner according to claim 4, wherein the lower housing comprises a bottom wall and a side wall arranged along a circumferential direction of the bottom wall, and the side wall of the lower housing is connected with a side wall of the upper housing.

7. The vacuum cleaner according to claim 1, wherein the dust suction assembly is arranged on the upper cover assembly, the dust suction assembly comprises a throat pipe and a dust suction accessory connected to the throat pipe, the throat pipe comprises a soft throat pipe and a hard throat pipe arranged on both sides of the soft throat pipe, a first side of the soft throat pipe is fixed on the upper cover assembly through the hard throat pipe, and a second side of the soft throat pipe is connected to the dust suction accessory through the hard throat pipe.

8. The vacuum cleaner according to claim 7, wherein the upper cover assembly further comprises an accessory groove housing the dust suction accessory, and the upper cover assembly is provided with a fixing component to fix the hard throat pipe and a groove to house the soft throat pipe, the fixing component is a circular arc-shaped gasket, as in a storing state, the hard throat pipe at the second side is located on the gasket to match the groove to fix and limit the throat pipe.

9. The vacuum cleaner according to claim 1, wherein the upper cover assembly is provided with an air inlet communicated with the dust suction assembly, and an air outlet is arranged between the middle cover assembly and the upper cover assembly.

10. The vacuum cleaner according to claim 1, wherein the motor is a brushless motor.

11. The vacuum cleaner according to claim 10, wherein the brushless motor comprises a fan blade for heat dissipation, and the fan blade is arranged between the brushless motor and the impeller.

12. The vacuum cleaner according to claim 10, wherein the brushless motor comprises a fan blade for heat dissipation, and the fan blade is arranged at an end of the brushless motor away from the impeller.

13. The vacuum cleaner according to claim 1, wherein a ratio of a rated rotating speed of the impeller to a diameter of the impeller is not less than 220 r/(min*mm), the rated rotating speed of the impeller is not less than 20000 rpm.

14. The vacuum cleaner according to claim 1, wherein the diameter of the impeller is between 60 mm and 80 mm.

* * * * *